US006966085B1

(12) United States Patent
Cretsinger et al.

(10) Patent No.: US 6,966,085 B1
(45) Date of Patent: Nov. 22, 2005

(54) SLEEP SYSTEM

(76) Inventors: W. Gene Cretsinger, 1967 51st St. NE., Cedar Rapids, IA (US) 52402; Steven R. Kunert, 2617 Rainier Ct. NE., Cedar Rapids, IA (US) 52402

( * ) Notice: Subject to any disclaimer, the term of this patent is extended or adjusted under 35 U.S.C. 154(b) by 0 days.

(21) Appl. No.: 10/798,002

(22) Filed: Mar. 11, 2004

(51) Int. Cl.[7] ..... A47C 19/00
(52) U.S. Cl. ..... 5/201; 5/249
(58) Field of Search ..... 5/400, 401, 201, 5/724, 202, 263, 253, 258, 285, 246, 248, 5/249, 719

(56) References Cited

U.S. PATENT DOCUMENTS

| | | | | | |
|---|---|---|---|---|---|
| 46,119 | A * | 1/1865 | Lord | 5/258 |
| 51,981 | A * | 1/1866 | Todd | 5/258 |
| 419,253 | A * | 1/1890 | Holmes | 5/258 |
| 683,344 | A * | 9/1901 | Sim | 5/258 |
| 687,436 | A * | 11/1901 | Revell | 5/716 |
| 804,352 | A * | 11/1905 | Van Cise et al. | 5/246 |
| 837,751 | A * | 12/1906 | Summers | 5/246 |
| 912,855 | A * | 2/1909 | King | 5/263 |
| 1,255,151 | A * | 2/1918 | Franz | 5/253 |
| 1,259,401 | A * | 3/1918 | Holmlund | 5/248 |
| 1,455,872 | A * | 5/1923 | Gail | 5/230 |
| 1,619,916 | A * | 3/1927 | William | 267/91 |
| 1,836,353 | A * | 12/1931 | Withrow | 248/574 |
| 2,737,666 | A * | 3/1956 | Herider et al. | 5/264.1 |
| 2,994,890 | A * | 8/1961 | Wagner | 5/718 |
| 3,204,016 | A * | 8/1965 | Sanger et al. | 264/46.7 |
| 4,116,735 | A * | 9/1978 | Plasse | 156/79 |
| 4,254,786 | A * | 3/1981 | Won | 132/325 |
| 4,555,097 | A * | 11/1985 | Hiatt | 267/100 |
| 4,956,884 | A * | 9/1990 | Hwang | 5/246 |
| 6,128,798 | A * | 10/2000 | Barman et al. | 5/716 |
| 6,272,706 | B1 * | 8/2001 | McCune et al. | 5/720 |
| 6,668,406 | B2 * | 12/2003 | Spinks et al. | 5/655.8 |
| 6,842,927 | B2 * | 1/2005 | England | 5/739 |
| 2003/0079284 | A1 * | 5/2003 | Gaboury et al. | 5/201 |

* cited by examiner

*Primary Examiner*—Heather Shackelford
*Assistant Examiner*—Gay Ann Spahn
(74) *Attorney, Agent, or Firm*—Suiter West Swantz pc llo

(57) ABSTRACT

A sleep system, for providing a bed, includes a frame with cross support members coupled with a first and second panel assembly. A sleep support mechanism operationally engages the first and second panel assemblies with one another and further engages a pad to provide adjusting support to the user. The sleep support mechanism employs a cone coupled with a first and second spring, the first and second spring further coupling with the first and second panel assemblies, and the cone engaging with the pad to provide the adjustable support capability.

7 Claims, 10 Drawing Sheets

SLEEP SYSTEM

FIELD OF THE INVENTION

The present invention generally relates to the field of sleeping devices, and particularly to a sleep system for establishing a bed.

BACKGROUND OF THE INVENTION

The field of sleep devices is well developed. The prior art provided by these devices encompass a wide range of features to promote sleeping. From adjustable beds, to mattresses composed of various materials, to frame support features which enable various movement capabilities, such innovative ideas have shaped the bedding industry and sleep habits of many.

Unfortunately, many of the current sleep systems may not enable an operator to convert between different bed sizes, such as a twin size, queen size, and king size bed. Further, these sleep systems may not be readily transportable by the user. Typically, the supporting features of the current sleep systems are contained within the mattress. Unfortunately, this limits the supportive characteristics which a user of such sleep systems may experience from any one of these sleep systems. Still further, these mattresses provide a closed environment within which various contaminants are given a place to nest and grow, establishing less than healthy sleep environments for the user.

Therefore, it would be desirable to provide a sleep system which enables the user to convert between various bed sizes and transport the sleep system between remote locations. Additionally, it would be desirable to provide a sleep system which assists in promoting a healthier sleep environment and may enable a user to adjust the support characteristics provided by the sleep system.

SUMMARY OF THE INVENTION

Accordingly, the present invention provides a sleep system which enables a user to break it down into a size which promotes its efficient transportation. Further, the sleep system of the present invention promotes a healthier sleep environment, accommodates various bed size requirements, such as to establish a twin size bed, a queen size bed, and/or a king size bed, and adjustable support characteristics.

The present invention provides these capabilities by employing a uniquely advantageous system of establishing a bed. A sleep support mechanism of the present invention may couple with a first panel assembly and a second panel assembly, to establish the sleep surface. The first and second panel assemblies may require assembly and thus be capable of being disassembled to promote the ease with which a user may transport the panels. The panels may further be established and converted between different bed sizes, as previously described. The sleep support mechanism's coupling is provided by a first spring coupling with the first panel assembly and a cone, while a second spring couples with the second panel assembly and the cone. This dual spring mechanism enables the first and second panel assemblies with adjustment capabilities relative to one another. Further, the sleep support mechanism may employ alternative configurations to enable the coupling of the first and second panel assemblies.

In an aspect of the present invention, a frame is provided which connects with a first panel assembly and a second panel assembly which are coupled with one another via a sleep support mechanism. The frame may require assembly and is thus capable of being disassembled for promoting the ease with which a user may transport the frame. Further, the frame is enabled to be established and converted between different bed sizes, as previously described, by the user.

In another aspect of the present invention, a sleep system provides a pad which couples with a first panel assembly which is coupled with a second panel assembly. The first and second panel assemblies are further coupled with a frame and thus a bed is established for a user. The sleep system may require assembly and thus may be disassembled to promote easier transportation of the sleep system. Further, the sleep system may enable the establishment and convertibility between various bed sizes as describe previously.

In a still further aspect of the present invention a method of establishing a bed, is provided. The user first determines the size of the bed they wish to establish. The user then establishes a sleep system in the desired bed size. A unique advantage of the present invention is the ability to be established or convert between various bed sizes.

It is a further object of the present invention to provide a sleep system which promotes a healthier sleep environment. The present invention establishes the first panel assembly and the second panel assembly as an open system of panels. The open system of panels significantly reduce the amount of germs, dust, and mites which may accumulate. It is a still further object to the present invention to provide an environmentally friendly sleep system. In order to accomplish this goal, the component features of the present invention may be composed of recyclable material.

In accordance with promoting easier transporting of the present invention, described previously, it is an object of the present invention to provide for the ability of the present invention to be packaged in transportable containers. The containers may provide for an increased ease of storage of the sleep system and promote commercial success by promoting easier storage on shelves and commercial identifiers being included on the containers.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 10, exemplary embodiments of the present invention are shown.

Figure 1:
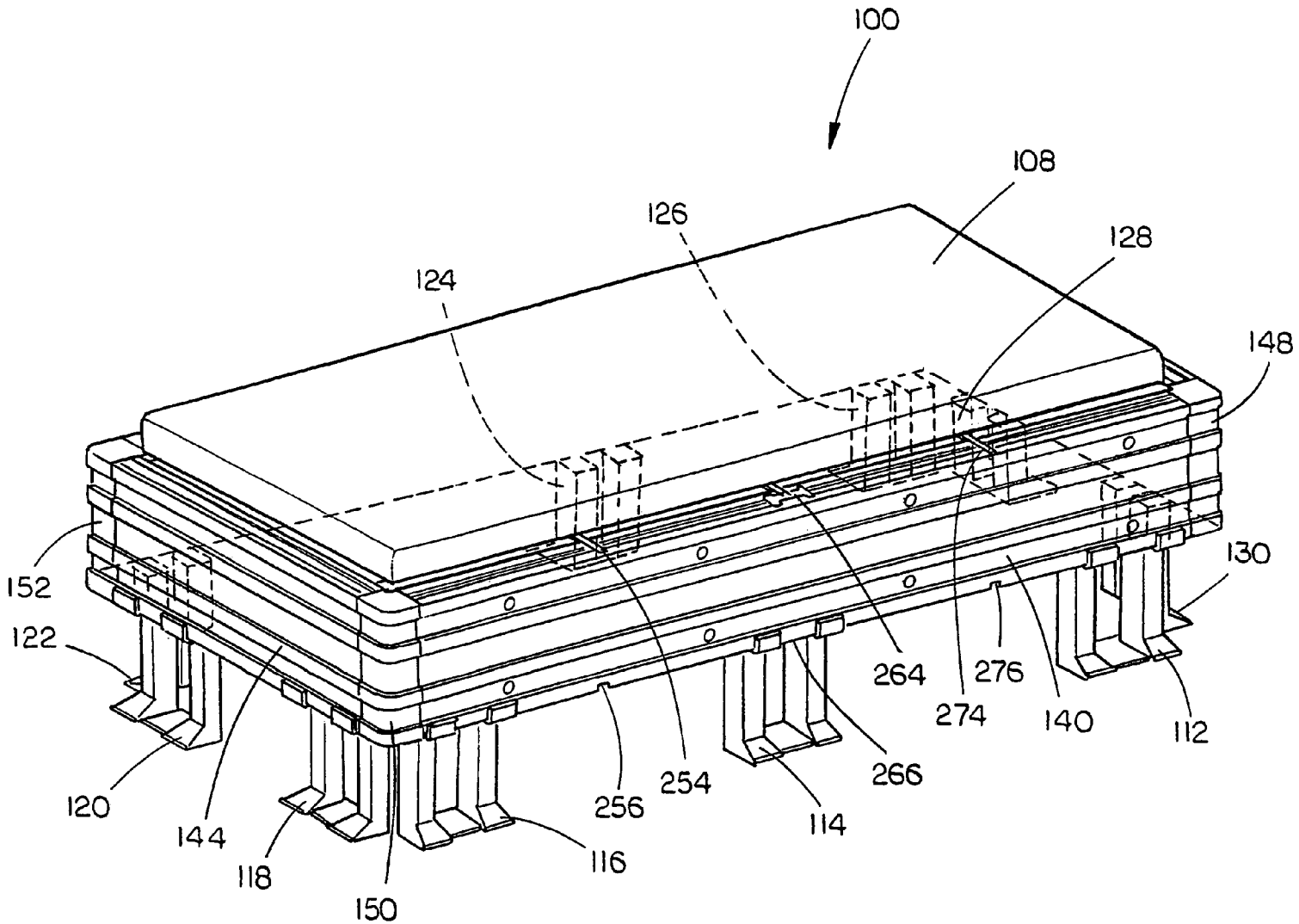
FIG. 1 is an illustration of a sleep system in accordance with an exemplary embodiment of the present invention.

A sleep system 100 including a frame 102 coupled with a first panel assembly 104 and a second panel assembly 106, the first and second panel assemblies are further coupled with one another via a sleep support mechanism 110, is shown in FIG. 1. A pad 108 is coupled with the sleep support mechanism 110, the sleep support mechanism 110 providing adjustable support to the pad 108. The pad 108 providing a surface for a user to seat upon or lie down on. The frame may be further coupled with a frame support mechanism. In the current embodiment, shown in FIGS. 2, 3, and 4, the sleep system 100 employs a single sleep support mechanism 110. It is understood that any number of sleep support mechanisms may be employed with the sleep system 100 without departing from the scope and spirit of the present invention.

The frame 102 may be established through the connection of a plurality of pieces. In the current embodiment, the frame 102 includes a first rail member 140, a second rail member 142, a first end rail 144, and a second end rail 146. The frame further includes a first corner connector 148, a second corner connector 150, a third corner connector 152, and a fourth corner connector 154. The first through fourth corner connector couple with the ends of the first and second rail members and the ends of the first and second end rails. The first through fourth corner connectors further provide for the connection of the first rail member 140 with the first and second end rail 144 and 146 and the connection of the second rail member 142 with the first and second end rail 144 and 146.

In a preferred embodiment, the first and second rail member 140 and 142 and the first and second end rail 144 and 146 are generally configured in a rectangular box shape. Thus, the first and second rail members have a configuration with a defined length, width, and height, and the first and second end rails have a configuration with a defined length, width, and height. In the current embodiment, the width and height of the first and second rail members and the first and second end rails are equal to one another. However, it is contemplated that the first and second rail members and end rails may be variously configured relative to one another providing different length, width, and height dimensions. In a preferred embodiment, the first and second rail members and the first and second end rails define an inner recess which runs the length of the rail members and the end rails. It is understood that the configuration of the rail members and end rails may be established to provide an optimal height setting for the pad 108 of the sleep system 100, when the frame 102 is coupled with the frame support mechanism. Alternatively, the frame 102 may provide the pad 108 at an optimal height when the frame 102 is seated on an existing bed frame, as will be further discussed below.

Additionally, the first and second rail members as well as the first and second end rails include grooving. In a preferred embodiment, the first rail member includes a first side 170, which includes a first groove 171 and a second groove 172, and a second side 173, which includes a third groove 174 and a fourth groove 175. The grooves, being included on both the first and second sides, enable the first rail member 140 to provide its designated function regardless of the orientation of the first and second sides. The functional characteristics of the grooves will be described below. It is understood that the second rail member 142, first end rail 144, and second end rail 146, may include grooves which are similar in every respect to the grooves established on the first rail member 140 and described with respect to the first rail member 140. In an alternative embodiment, the rail members and end rails may be established with grooving, as described above, on only one side. The opposite side may be configured with a smooth surface, include contouring, or various other features as contemplated by those of ordinary skill in the art.

The first through fourth corner connector 148 through 154 are configured generally in a rectangular box shape which is optimally sized to couple with both the first and second rail members and end rails. It is understood that the configuration of the corner connectors may vary as contemplated by those of ordinary skill in the art. The corner connectors may enable the coupling with the first and second rail members and end rails in various manners. In a preferred embodiment, the rail members and end rails at least partially insert into the corner connectors in order to securely fasten. Thus, it is contemplated that each end of the rail members and end rails may include one or more tongue members which couple with grooves established within the corner connectors. The coupling mechanisms may include the use of various fasteners, friction fit systems, compression lock systems, latch systems, snap fit systems, and the like.

It is understood that the corner connectors, in the current embodiment, are configured to provide the corners of the frame 102. The outer configuration may be established to match the pattern of the rail members and end rails. Alternatively, the corner connectors may provide a different outer appearance than that of the rail members and end rails. It is contemplated that the corner connectors may further include an internal support system to provide increased structural strength. Alternatively, the corner connectors may be of thicker dimensions to provide the increased structural integrity. Still further, it is contemplated that the corner connectors may be a generally solid piece of material, enabling the coupling with the first and second rail members and end rails, in order to provide the increased strength desired.

The component features of the frame 102 may be further coupled with a cross support mechanism. In a preferred embodiment, the cross support mechanism is enabled by a first cross support member 202, a second cross support member 204, and a third cross support member 206. In a preferred embodiment, the cross support members are connected with the first and second rail member 140 and 142 via a plurality of cross support member fasteners. The cross support member fasteners engage on one end with the first or second rail members and on the other end with the cross support members. The first cross support member 202 is coupled with a first cross support member fastener 250, a second cross support member fastener 252, a third cross support member fastener 254, and fourth cross support member fastener 256. The second cross support member 204 is coupled with a fifth cross support member fastener 260, a sixth cross support member fastener 262, a seventh cross support member fastener 264, and an eighth cross support member fastener 266. The third cross support member 206 is coupled with a ninth cross support member fastener 270, a tenth cross support member fastener 272, an eleventh cross support member fastener 274, and a twelfth cross support member fastener 276.

In the current embodiment, the end of the cross support member fasteners which couple with the cross support members is enabled as a snap fit mechanism coupling at least partially around the cross support members. Further, the opposite end of the cross support member fastener is enabled as a latch system, with a catch coupling to a receiver disposed in the rail member. It is understood that various coupling mechanisms, such as a compression assembly, friction fit system, fastener system, and the like, may be employed without departing from the scope and spirit of the present invention.

Figure 2:
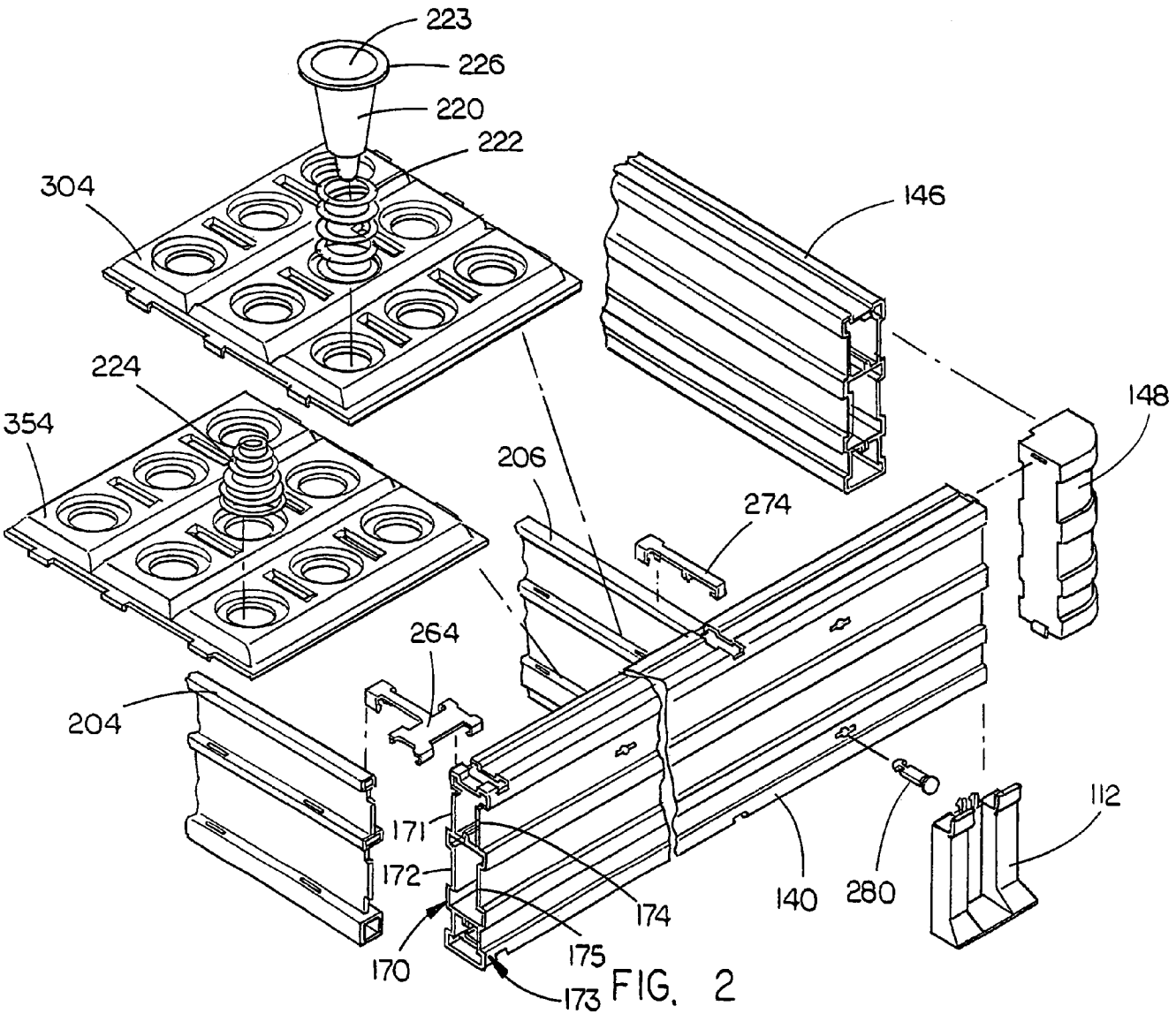
FIG. 2 is an exploded view of the sleep system of the present invention.
Figure 7:
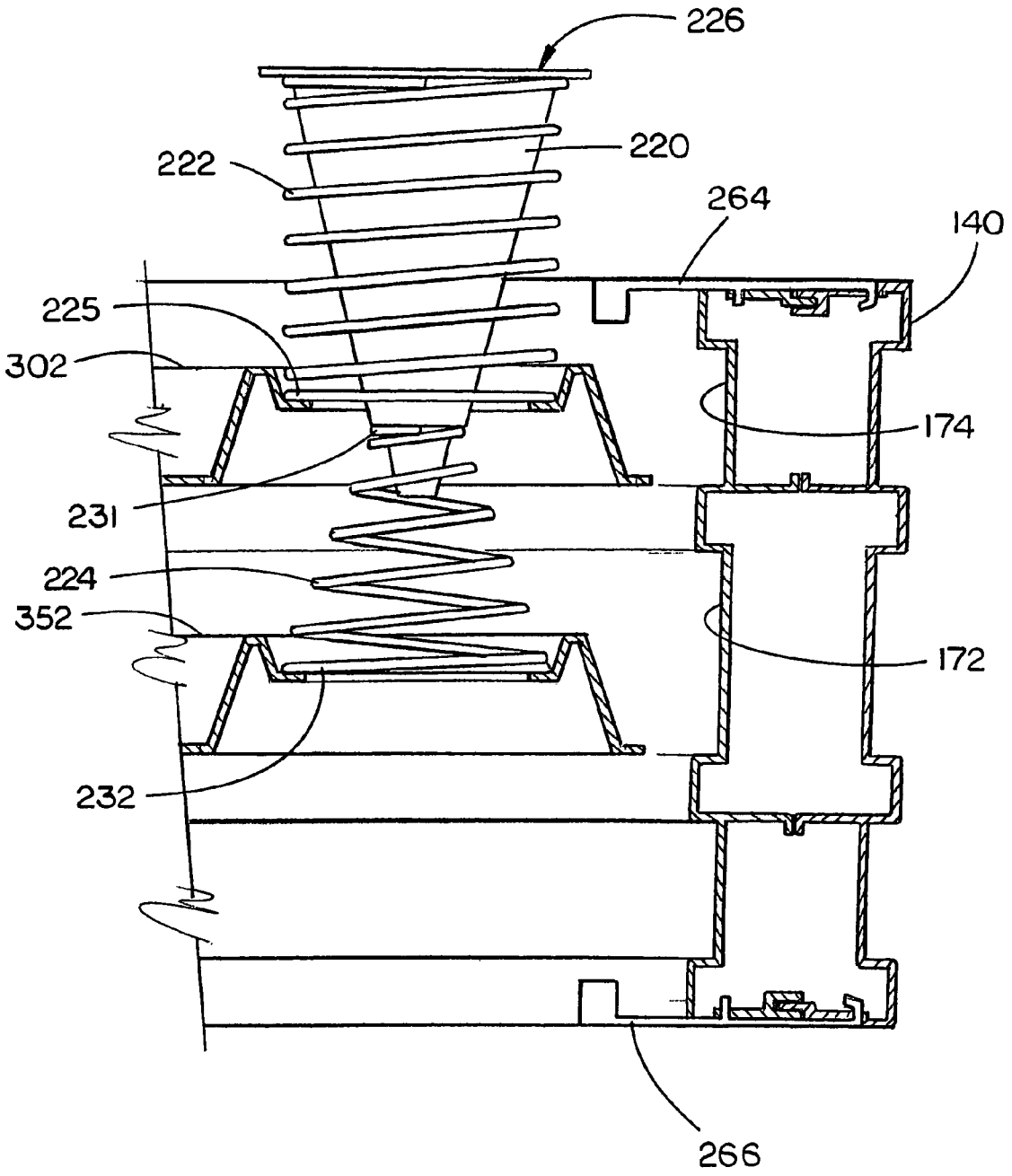
FIG. 7 is a side view illustrating the sleep support mechanism coupled with the first and second panel assemblies, the first and second panel assemblies further coupled with a cross support member coupled with a rail member.

The cross support members 202 through 206 are preferably configured as beams with a length. In a preferred embodiment, the length spans across the gap between the first and second rail members. A width of the beam matches the width of the first and second rail members. It is contemplated that the length and width of the cross support members may be varied as contemplated by those of ordinary skill in the art. Each end of the cross support members is further directly coupled with the first or second rail member, thereby, providing a lateral support to the rail members. Each end of the cross support members couple with the first and second rail members by engaging with the grooves in the rail members, described previously. It is understood that each end of the cross support member may be generally configured with a plurality of tab members for seating in the grooves of the rail members, as shown in FIGS. 2 and 7.

Alternatively, the first and second rail members may enable the ends of the cross support members to couple within the defined recess established in the first and second rail members. The ends of the cross support members may include various secondary members which may further couple with the rail members. For example, a secondary tab member may further extend from the end of the cross support member to engage with a tab receiver established on the rail members. It is further contemplated that the cross support members may couple with the rail members using various fasteners, such as screws, bolts, pins, clips, and the like. Advantageously, the cross support members may be removed from their coupling with the rail members. However, the cross support members may be integral with the rail members. For instance, the first rail member 140 may be pivotally connected with the cross support members. Thus, when disassembled the cross support members may be pivoted into a position which enables the first rail member 140 to be packaged, as will be described below. When the sleep system is being assembled, the cross support members may be pivoted into position and coupled on the opposite end with the second rail member. It is understood that the cross support members coupling with the first and second rail members may be established in various ways, as contemplated by those of skill in the art, without departing from the scope and spirit of the present invention.

In an alternative embodiment, the cross support members 202 through 206 may be established as multiple beam assemblies. For instance, the first cross support member 202 may be established as a three beam assembly. A first beam may couple with the first and second rail member establishing a roughly planar relation to a top surface of the rail members. A second beam may couple with the rail members establishing a roughly planar relation to a bottom surface of the rail members. A third beam may couple with the rail members in a position between the top surface and bottom surface of the rail members. The coupling of the multiple beams may occur through the use of the cross support member fasteners, as described above, or through various other mechanical systems which provide for securing the beams with the rail members as contemplated by those of skill in the art. It is understood that various other mechanical configurations for establishing the cross support mechanism may be enabled with the present invention without departing from the scope and spirit of the present invention.

The current embodiment of the present invention, enables the frame 102 to be dis-assembled into its component parts. This ability enables the component parts of the frame 102 to be re-assembled with various parts. This further assists in the sleep system 100 having the ability to be converted between various bed sizes as desired by the user of the sleep system 100. For instance, the frame 102 may be assembled using component parts which establish its configuration for providing the equivalent of a standard twin size bed. Alternatively, the frame 102 may be assembled into a configuration for providing the equivalent of a queen size bed or king size bed. It is understood that the assembling and dis-assembling of the frame 102 enables the sleep system 100 to go from a standard twin to a queen or king and then back again. This convertibility may be a significant advantage for the sleep system 100 over currently available products.

A plurality of secondary lateral supports for the first and second rail members and end rails is provided by the present invention. In a preferred embodiment, the secondary lateral supports are a plurality of plugs which extend from one side of the defined recessed area within the first and second rail members and end rails to the other side. The plurality of plugs couple with the first and second rail members and end rails through a first and a second plug receiver disposed on opposite sides of the defined recessed areas. The plugs may be variously configured to couple and provide lateral support to the rail members and end rails. In FIG. 2, a plug 280 is shown to couple with a plug receiver of the first rail 140. The plug 280 is exemplary of the plurality of plugs used with the sleep system 100 of the present invention.

The plugs may preferably be composed of a material having at least some flexion, stretching, and/or deflection characteristics to enable a degree of lateral movement. For instance, the plugs may be composed of a semi-rigid rubber material which enables the members and end rails to laterally adjust to shifting weight conditions placed upon them by the user of the sleep system 100. Alternatively, materials such as plastic may be employed and the degree of lateral movement enabled by the plugs may be increased or decreased. The number and location of the plurality of plugs within each of the rail members and end rails may vary. However, it is preferred that the number and location of plugs correspond with the number and location of plug receivers.

The first and second panel assemblies 104 and 106 establish a generally planar first and second surface for the sleep system 100. In a preferred embodiment, the second panel assembly 106 is disposed in a location below the first panel assembly 104. The first panel assembly 104 includes a first panel 302, a second panel 304, a third panel 306, and a fourth panel 308. The second panel assembly includes a first panel 352, a second panel 354, a third panel 356, and a fourth panel 358. In general, the configuration of the first through fourth panels of the first and second panel assemblies establishes the panels in a rectangular configuration. Each of the panels are further disposed with a panel support system. In the current embodiment, the panel support system includes a plurality of panel support receivers and a plurality of panel support slots. The plurality of panel support receivers and slots assist in promoting a healthy sleep environment. This is accomplished by the open structure of the plurality of panel support receivers and slots, which provide no closed spaces for germs, dust, mites, and various other contaminates, to accumulate. Air is enabled to circulate freely within the structure of the sleep system 100 and the pad 108 may be easily replaced.

The plurality of panel support receivers are established as circular apertures which extend through the panels of the first and second panel assemblies. The apertures establish an outer diameter and an inner diameter. In the current embodiment, the inner diameter is established by a ledge member forming a depressed ledge inside of the circumference established by the outer diameter. The number and configuration of the panel support receivers and slots may be varied to accommodate the needs of consumers and manufacturers to provide for the customization of the sleep system 100.

The plurality of panel support receivers and the panel support slots are arranged upon and through the panels in a generally repeating geometric pattern. It is understood that the pattern of panel support receivers and slots may be established in various other configurations as contemplated by those of skill in the relevant art. For example, the number of panel support receivers may be limited and selectively placed in various locations upon various panels of the first or second panel assembly. In the current embodiment, the plurality of panel support receivers of the first panel assembly 104, align vertically with the plurality of panel support receivers of the second panel assembly 106. This vertical alignment enables the plurality of panel support receivers to connect the first and second panel assemblies with the sleep support mechanism 110, the sleep support mechanism 110 being described in detail below.

In alternative embodiments of the present invention the first and second panel assemblies each may include a single panel disposed with the plurality of panel support receivers and slots. It is further contemplated that the first and second panel may be connected to one another utilizing various mechanical connection assemblies in conjunction with the connection established by the sleep support mechanism 110. It is understood that the number of sleep support mechanism 100 may vary. With the panel assemblies 104 and 106 comprising a plurality of panel support receivers, it is contemplated that each panel support receiver may be coupled with an individual sleep support mechanism 110. In such an embodiment, the pad 108 may be engaged by a plurality of sleep support mechanisms, providing the adjustable support of the present invention.

Figure 4:
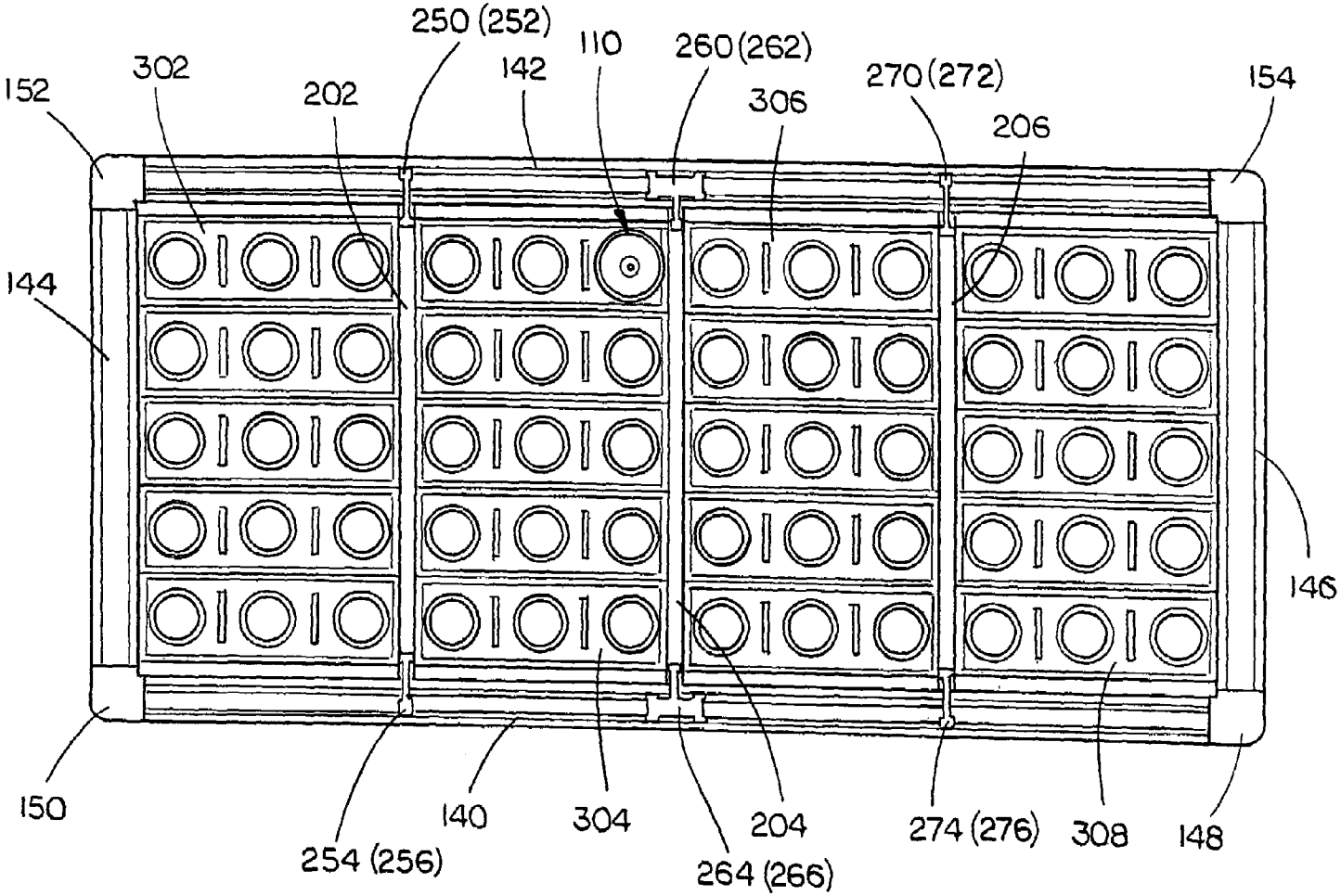
FIG. 4 is a top view of the sleep system.
Figure 5:
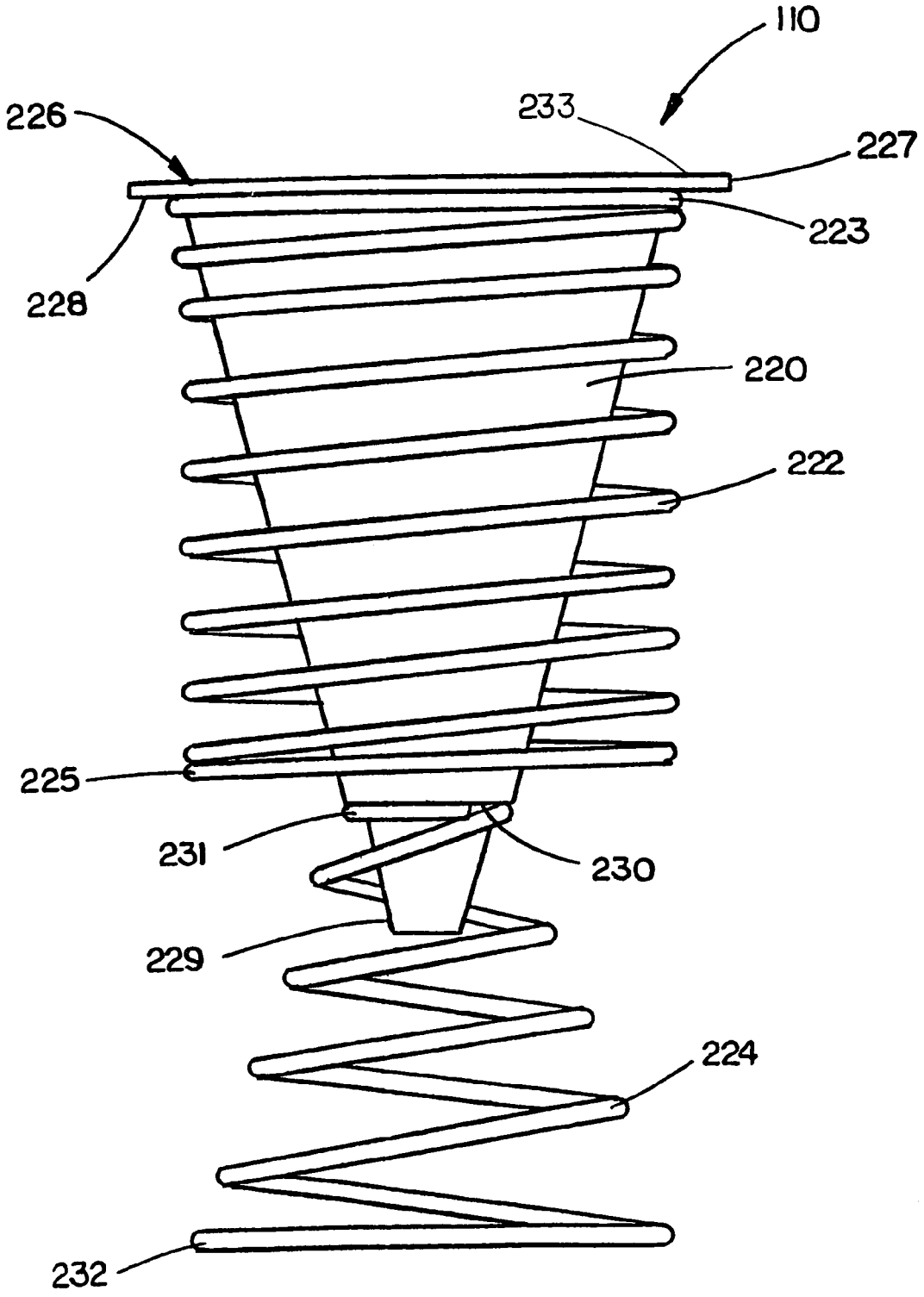
FIG. 5 is a side view illustrating a sleep support mechanism in accordance with an exemplary embodiment of the present invention.
Figure 6:
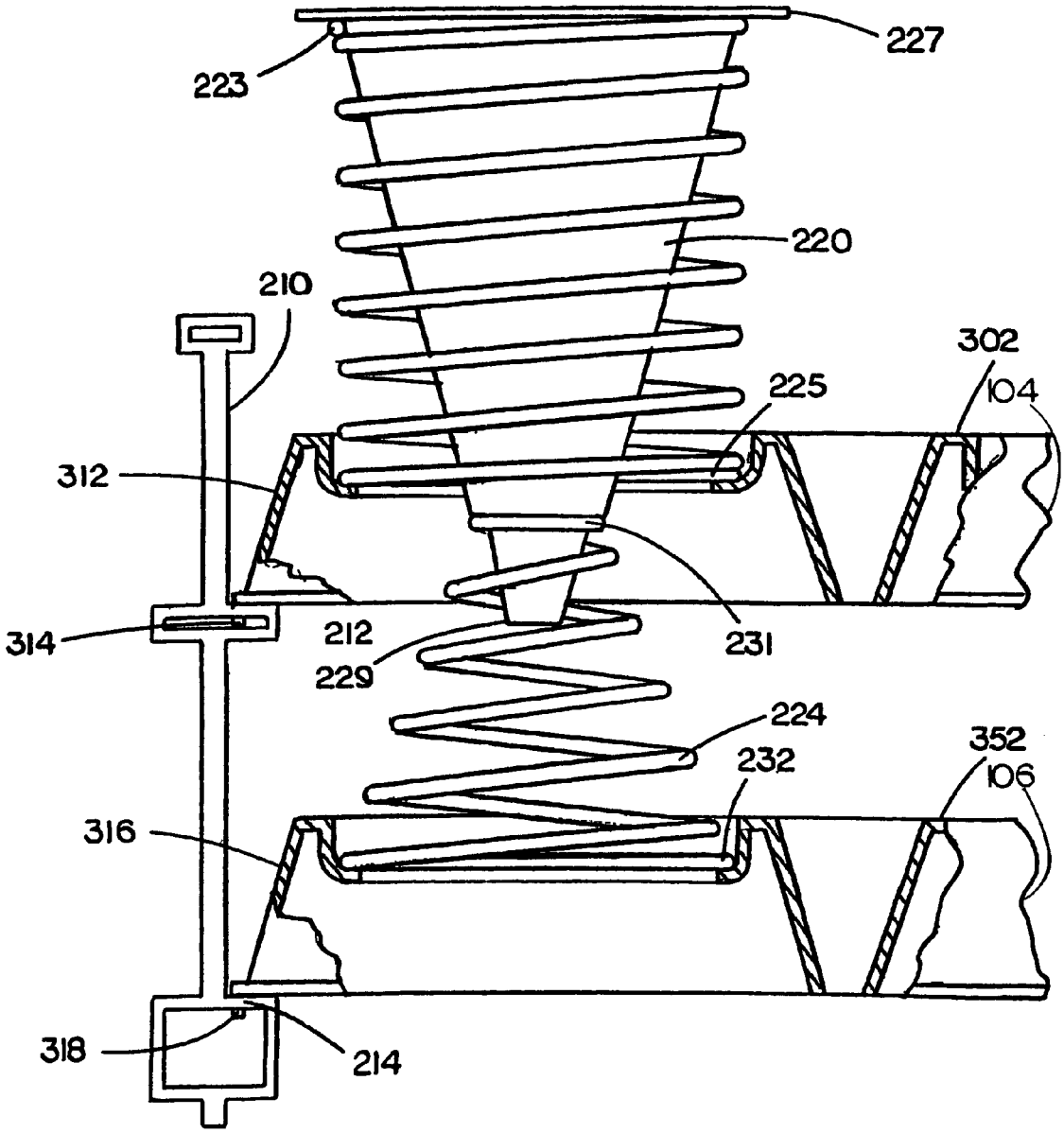
FIG. 6 is a side view illustrating the sleep support mechanism coupling with a first panel assembly and a second panel assembly.
Figure 8:
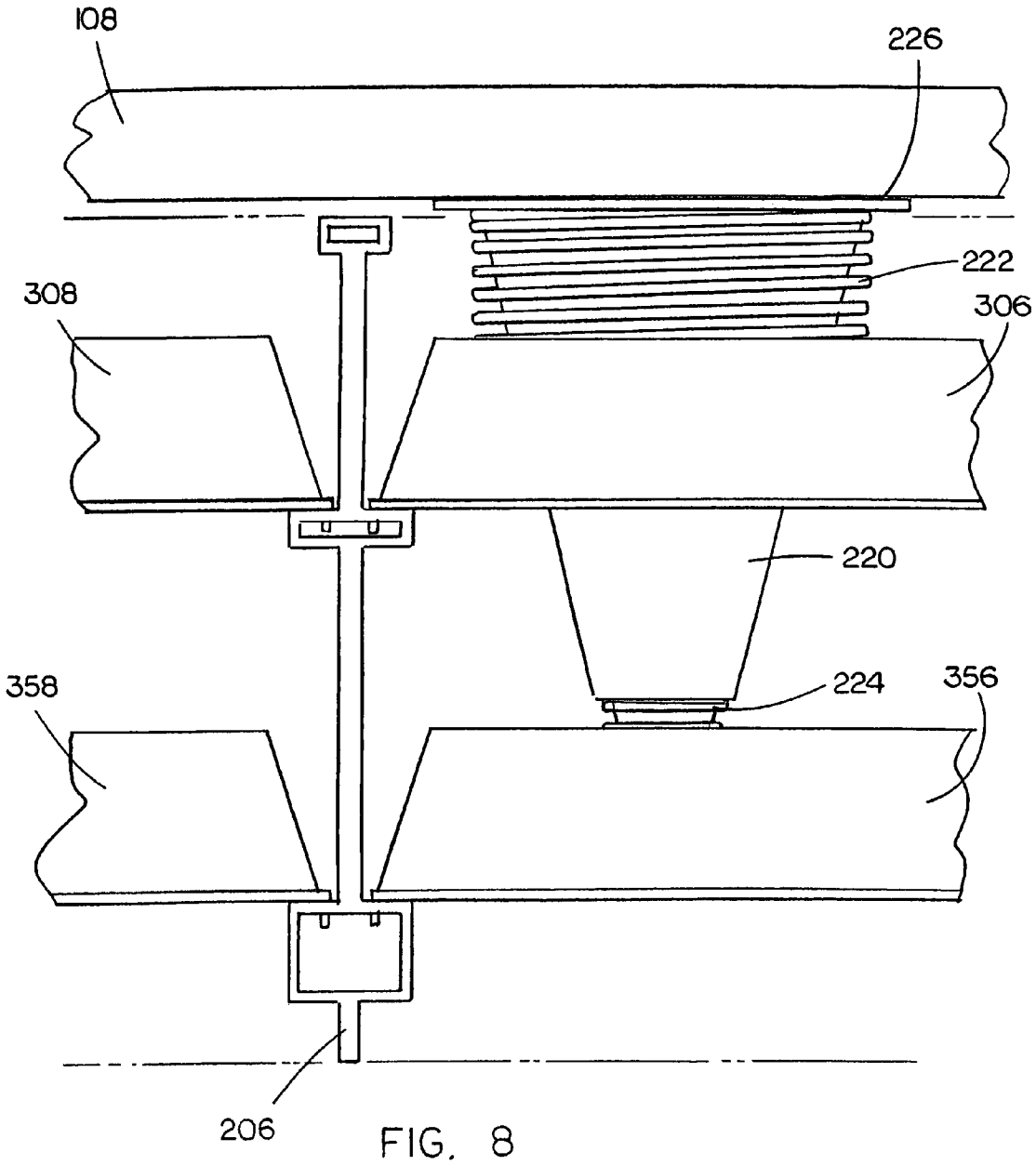
FIG. 8 is a side view illustrating the sleep support mechanism engaged by a pad of the sleep system.

In a preferred embodiment, the first, second, third, and fourth panels of the first and second panel assembly 104 and 106 couple with the first and second end rail 144 and 146 and the cross support members 202 through 206 of the frame 102. FIGS. 6 and 8 illustrate the first panel assembly 104 and second panel assembly 106 coupled with the frame 102. It is understood that the second panel assembly 106, while hidden from view due to the vertical alignment of the first and second panel assembly 104 and 106 in FIG. 4, is coupled in a similar manner. In FIG. 6, the second panel 304 and sixth panel 354 are shown coupled with an exemplary cross support member, which may be any of the three cross support members 202, 204, or 206. The second panel 304 includes an edge 312. The edge 312 includes a coupling member 314. In the current embodiment, the coupling member 314 is a tab. The tab 314 inserts within a first receiver 212 disposed on a first side 210 of the cross support member. The first receiver 212 is established as a ledge including a slot for receiving the coupling member 314. It is contemplated that at least a portion of the first edge 312 may contact against the ledge established by the first receiver 212. The sixth panel 354 includes an edge 316 which couples with a second receiver 214 established on the first side 210 of the exemplary cross support member. The edge 316 further including a coupling member 318, similar to the coupling member 314 described above and providing similar coupling functionality with the second receiver 214. As stated previously, the plurality of panels which establish the first and second panel assemblies are similar in every respect. Thus, the panels 304, 306, 308, 354, 356, and 358, as shown in FIGS. 2, 6, 7, and 8, include similar functional features and are coupled in a similar manner.

It is understood that each panel may include multiple coupling members included upon a first and second edge of the panel. In a preferred embodiment, shown in FIG. 2, each panel includes three coupling members disposed on the first and second edge of the panel. The number, location, and configuration of the coupling members may vary. Correspondingly, the number, location, and configuration of receivers disposed on the cross support members may vary to accommodate the coupling of the panels with the cross support members.

It is understood, from FIG. 4, that the panel 302 and 308 couple with the first and second end rails, respectively. Panels 352 and 358, which align directly under panels 302 and 308, also couple with the first and second end rails. Therefore, an edge of these panels is enabled to couple with the end rails 144 and 146. This coupling may occur utilizing a variety of mechanical connector systems. In a preferred embodiment, the edge of the panels insert within a groove established on the end rails, as previously described. The insertion may provide sufficient coupling to support the functioning of the sleep system 100. It is contemplated that the coupling may be further established through the coupling of coupling members, disposed on the edge of the panels as described above, with receivers, as described above with respect to the cross support members, disposed on the end rails. It is further contemplated that the location, number, and configuration of the coupling members on the edge of the panels which couple with the rail members may be similar to, or vary from the location, number, and configuration of the coupling members disposed on the other panels.

Alternatively, the sides of the cross support members 202 through 206 may include a groove within which the edges of the panels may be inserted. In this tongue and groove enablement, the "tongue" of the panels may include similar coupling members as described above. The cross support members and panels may further enable the use of various fasteners, such as screws, bolts, pins, clips, and the like, to provide for the connection of the panels with the cross support members. It is further contemplated that the connection of the panels with the cross support members may be enabled through the use of various mechanical connector systems, such as compression lock systems, ball joint systems, snap lock systems, latch systems, and the like.

The first and second panel assembly 104 and 106 preferably maintain a separation distance between the first through fourth panels of each assembly and the first and second rail member 140 and 142 of the frame 102. This further promotes the healthy sleep environment established by the sleep system 100 by providing further open space between the components of the sleep system 100 through which air may circulate and contaminates may be prevented from finding a place to nest.

Figure 3:
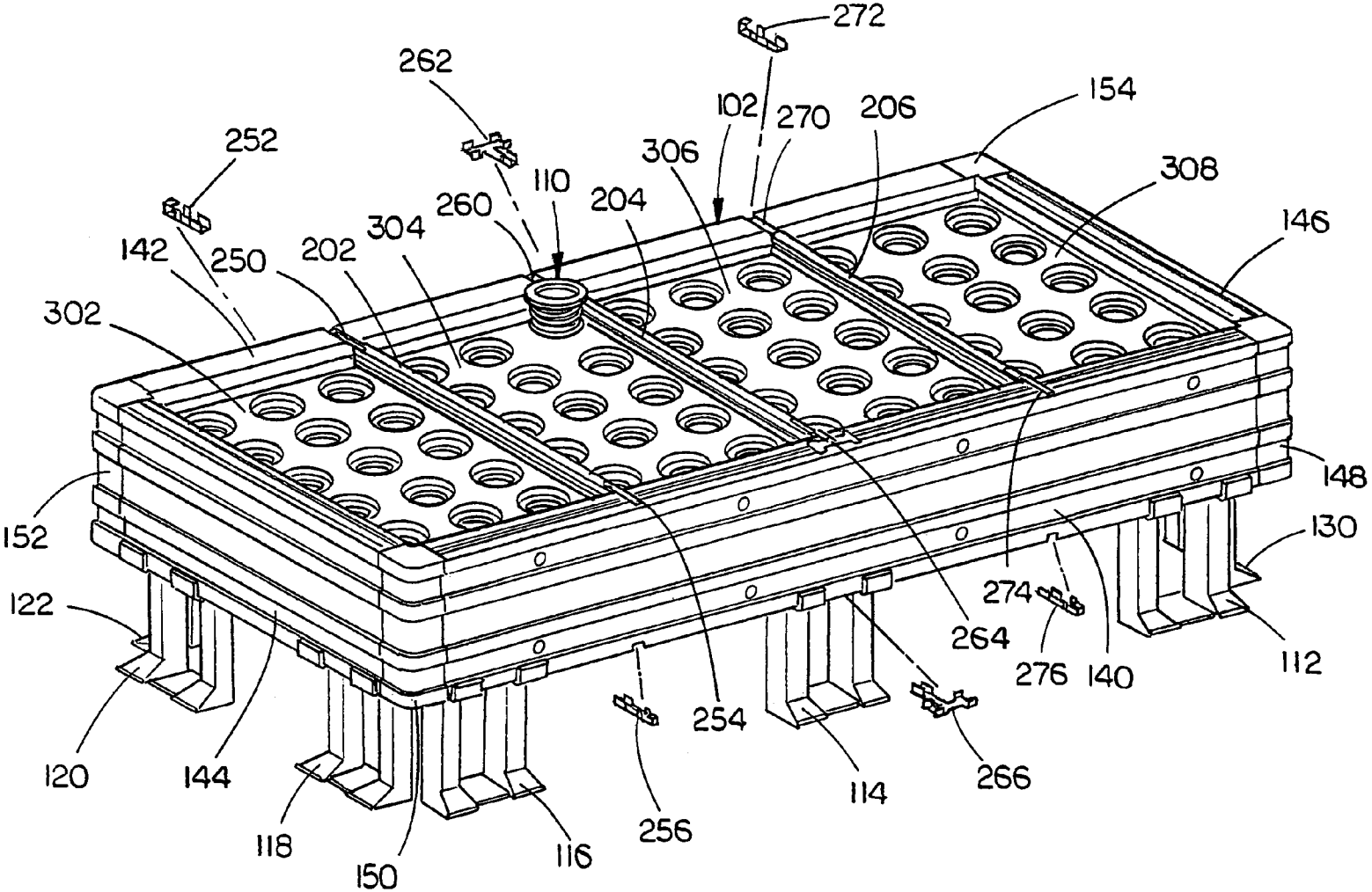
FIG. 3 is an isometric view illustrating the sleep system.

The coupling of the first and second edges of the panels with the first and second end rails and the cross support members further enables the panels to be removed from the frame 102. This capability may further promote the ability of the sleep system 100 to be converted for establishing various sized beds. FIGS. 1, 3, and 4 illustrate the sleep system 100 established in a standard twin bed configuration. The frame 102 may be converted, for instance, to a king size bed configuration. To accommodate this conversion the panels may first be removed from the frame 102. To establish the king size frame 102, additional frame components may be coupled with the existing standard twin frame 102. In operation, a third rail member may be coupled via a third and fourth end rail with either the first or second rail member. A fourth, fifth, and sixth cross support member may couple with the third rail member and either the first or second rail member. Then, after the frame 102 has been established in a king size bed configuration, the panels may be coupled with the end rails and cross support members. For a king size a third and fourth panel assembly, similar in every respect to the first and second panel assemblies, may be further coupled with the third and fourth end rails and the fourth, fifth, and sixth cross support members.

Alternatively, the sleep system 100 may be established as a queen size bed configuration. In a preferred embodiment, this configuration may be enabled by coupling a third and fourth rail member with the first and second rail members. Thus, the third and fourth rail members replace the first and second end rails of the sleep system 100. The third and fourth rail members may be configured and enabled to provide similar functionality as that provided by the first and second end rails. It is understood that the cross support members 202 through 206, of the sleep system 100, may be replaced with extended cross support members. The extended cross support members being similar in every respect and functional capability as the cross support members 202 through 206, except that the extended cross support members are preferably configured to substantially span the extended gap between the first and second rail members as a result of their coupling with the third and fourth rail members. Correspondingly, the first and second panel assemblies may be replaced by a first and second extended panel assembly which are similar in every respect and functional capability as the first and second panel assemblies, except that the first and second extended panel assemblies are preferably configured to substantially span the extended gap between the first and second rail members as a result of their coupling with the third and fourth rail members. Alternatively, the panel assemblies may be replaced with a first shortened panel assembly, a second shortened panel assembly, a third shortened panel assembly, and a fourth shortened panel assembly. The shortened panel assemblies, like the extended panel assemblies, are similar in every respect and functional capability as the first and second panel assemblies, except that the shortened panel assemblies are configured to span one half the distance of the gap being covered by the panel assemblies, in the queen size bed configuration.

It is understood that the components of the sleep system 100, such as the rail members, end rails, corner connectors, the panels of the panel assemblies, cross support members, cross support member fasteners, and frame support mechanism, may vary in number and configuration for establishment of one of the various size configurations enabled by the sleep system 100. It is the intent of the present invention to enable such variations in configurations without departing from the scope and spirit of the present invention.

The pad 108 provides a surface upon which the user of the sleep system 100 may lie down upon or interact with in various other manners. In a preferred embodiment, the pad 108 may be composed of a one-half inch thick rubber pad coupled with a three-quarter inch filler comfort pad, the filler comfort pad preferably being a foam material. Alternatively, the pad 108 may be composed of various other materials and thicknesses as contemplated by those of skill in the art. It is further contemplated that the pad 108 may be established as a standard mattress.

In a preferred embodiment, the sleep support mechanism 110 includes a cone 220 coupled with a spring assembly including a first spring 222 and a second spring 224. The cone has a first end 226 defining an inner diameter 233 and a second end 229. The first end 226 further includes a first catch 227. A first end 223 of the first spring 222 couples with an underside 228 of the first catch 227. In a preferred embodiment, the first catch 227 is a lip member circumferentially disposed about the first end 226 of the cone 220. It is contemplated that the first catch 227 may be variously configured as contemplated by those of ordinary skill in the relevant art. For example, the first catch 227 may include a secondary member coupled with the lip member for at least partially encompassing the first spring 222 when coupled against the underside 228 of the lip member. The cone 220 may be connected with the first panel assembly by the second end 225 of the first spring 222 coupling against the depressed ledge member coupled with the outer diameter of one of the plurality of support member receivers included on one of the panels of the first panel assembly. In a preferred embodiment, the second end 225 of the first spring 222 engages against the depressed ledge member of the support member receiver proximally disposed next to the cross support member and closest to the second rail member. It is understood that the cone 220 may be connected to any one of the plurality of support member receivers.

The cone 220 further includes the second end 229 which has a second catch 230 disposed proximally to it. The second catch 230 may be a contoured protrusion extending from the body of the cone and establishing a circumferential catch. The catch 230 is coupled by a first end 231 of the second spring 224. The second spring 224 further includes a second end 232 which couples with a depressed ledge member of one of the plurality of support member receivers established on one of the panels of the second panel assembly, which is in vertical alignment with the support member receiver through which the cone 220 is coupled on the first panel assembly.

In the current embodiment, the spring assembly is a dual spring assembly for providing adjusting and adjustable support to the pad 108 when the pad 108 is coupled against the support mechanism 110. The cone 220 is established with the first end open and defining an inner diameter which tapers down to the second end. The cone 220 may be composed of various materials. In a preferred embodiment, the cone 220 is composed of a plastic having a structural rigidity characteristic which may be defined by the manufacturer during production of the sleep system 100. It is further contemplated that the composition and therefore the structural rigidity characteristics of the cone 220 may be determined by a user, or others.

In an alternative embodiment, the support mechanism may be enabled by a cone connected with a spring assembly including only one spring. The one spring may connect on one end with the cone and on the other end connect against one of the plurality of support member receivers, as previously described.

It is contemplated that the spring assembly may employ more than two springs. Further, the springs utilized may be composed of various materials, such as different metals. The springs may be composed of various materials based on the tensile strength provided the springs by the material. The different tensile strengths of the different springs may establish varying degrees of support provided by the support mechanism 110 to the pad 108 and ultimately to the user. The different springs may be manufacturer or consumer determined, as will be described below.

In a preferred embodiment, the frame support mechanism includes a first foot 112, a second foot 114, a third foot 116, a fourth foot 118, a fifth foot 120, a sixth foot 122, a seventh foot 124, an eighth foot 126, a ninth foot 128, and a tenth foot 130. It is understood that the number of feet comprising the frame support mechanism may vary. Further, the location of the coupling of the various feet to the frame may be varied as contemplated by those of ordinary skill in the art. Each foot couples with the frame on one end and seats upon a surface with the opposite end. The feet are configured as a two post system including cross support bracing to provide stability. The cross supports may also be enabled to couple with the frame and/or seat upon the surface. It is contemplated that the feet may be configured as a single piece unit or as being comprised of a plurality of pieces connected together to form a foot.

The coupling of the feet 112 through 130 with the frame 102 allow the feet to be removed from the frame 102. In the current embodiment, the coupling is provided by a snap fit mechanism. Included upon each foot is a first and second snap member including a lip, the snap member extends the lip into a position where, when one of the feet is coupled with the frame, the lip is "snapped" into position over at least a portion of the frame 102. In order to remove the feet from the frame 102, the snap member may be engaged by a user to pull the lip back and disengage the lip from the frame 102. Thereupon, the foot may be removed from its coupled position with the frame 102. Further, the posts of the feet include a seat upon which the frame 102 may rest to further provide for the coupling of the frame 102 with the feet.

In an alternative embodiment, the feet 112 through 130 may be coupled with the frame 102 through the use of a spring loaded assembly. A tab member may be coupled with a spring which provides a force against the tab member for securing it against the frame and enabling the tab member to be retracted from its coupling with the frame to allow the foot to be removed. The tab member may include a ledge or may be a post which is received into the frame 102. The tab member may provide a stop against one side of the frame 102 to prevent the frame from disengaging from the foot. It is contemplated that the coupling of the feet with the frame 102 may utilize various other mechanisms, such as a compression lock assembly, ball joint assembly, latch assembly, and the like. The feet may even be coupled with the frame through the use of various fasteners, such as screws, bolts, clips, and pins, which may couple with both the foot and the frame to securely affix the position of the foot relative to the frame and further allow for the removal of the foot from the frame. Still further, the feet 112 through 130 may be integrated with the frame 102 to form a single piece frame unit with feet. The integration of the feet with the frame may occur through a variety of manufacturing processes, such as through an adhering process, as part of a molding process, through a welding process, and the like.

In a preferred embodiment, the feet 112 through 130 are generally configured to establish a height for the frame 102, when coupled with the feet, which places the pad 108 at a height which is optimal for the use of the sleep system 100 as a bed. Alternatively, the feet may be configured in various manners. For example, the feet may vary in height. Thus, a user of the sleep system 100 may be enabled to determine, from a selection of a variety of feet height, the bed height desired. The feet may include an adjustable height system wherein the user may adjust the height of the feet. This adjustable height system may be enabled for manual adjustment or automatic adjustment via the use of a controller.

In an alternative embodiment, the sleep system 100 may be coupled with an existing bed frame. For instance, a standard twin frame may be set up and then the frame 102 may be seated upon it providing the sleep system 100 on an existing frame. This embodiment may not require the use of the frame support mechanism, as described previously.

As discussed previously within this specification, the sleep system 100 enables a consumer to purchase a system which may promote a healthy sleep environment. Enabled with the ability to be dis-assembled and assembled in various configurations, the sleep system 100 may be packaged for retail purposes into a single compact "carry out" container. For instance, the present invention is contemplated to enable the frame to be packed in a thirty-six (36) inch by twenty-four (24) inch by fifteen (15) inch container. The container may include various commercial identifiers, such as logos, trademarks, symbols, lettering, numbering, and the like. Thus, the ease with which the sleep system 100 is moved and/or transported may be increased.

The container, within which the frame may be packaged, may serve as a storage box for future use. For example, after use of the sleep system 100 in one location a user may wish to move it to another location. Enabled by the capability of the sleep system 100 to be dis-assembled, the sleep system 100 may be re-packed into the container and then moved and/or transported.

The setting up or assembly of the sleep system 100 may provide a significant advantage over previous systems. The sleep system 100 may enable easier assembly by the consumer at the location of the consumer's choosing. It is contemplated that the sleep system 100 may be assembled without the use of tools. Alternatively, a consumer may be enabled to use tools which they posses to assemble the sleep system or tools which may assist the user in assembling the sleep system 100 may be included with the sleep system 100. Further, an instructional set may be provided with the sleep system 100 which may direct the user in the assembly of the sleep system 100.

The materials used for the various components of the sleep system 100, is preferably plastic. Alternatively, other materials, such as various metals, woods, composites, and the like, may be employed. In a preferred embodiment, the material may be of a transparent nature. Alternatively, the material may be of a translucent nature. It is contemplated that the materials may include one or more colors which may be applied to or integral with the various components.

The materials employed for the sleep system 100 may enable the components of the sleep system 100 to be recycled. It is understood that all components of the sleep system 100 may be recyclable or less than all components of the sleep system 100 may be recyclable.

It is contemplated that the sleep system 100 may further include bedding materials to be used. The bedding materials may be sized to fit with the pad 108 of the sleep system 100. For example, a fitted sheet and a flat sheet may be included with the sleep system 100. Additionally, a pillow and pillow casing may be included. The number of bedding materials may be varied to accommodate varying needs of consumers. Further, the sleep system 100 may enable the use of existing bedding materials which may be employed with other beds. Alternatively, the sleep system 100 may include various other component features, such as rail cushions which may couple with the rail members to assist in increasing user comfort of the present invention. Exemplary rail cushions may be established as two and three-quarter inch foam pads with a cover.

The packaging of the sleep system 100 for commercial purposes may provide sleep systems with various additional features. For example, one packaged sleep system may include two rail members and two end rails for establishing a twin frame. Another sleep system may include four rail members for establishing a queen frame or three rail members and four end rails for establishing a king frame. Corresponding changes in the cross support members, panel assemblies, and frame support mechanism may be included.

Further, various sleep support mechanisms may be enabled within a packaged sleep system. For example, a sleep system may be provided with multiple cones with varying structural characteristics to enable the consumer to customize the support provided by the sleep system. Additionally, multiple springs with varying tensile strengths may be provided for the customization of the support provided by the consumer.

It is further contemplated that the present invention may include separate packages containing various component feature options for use with the sleep system 100. For example, a cone package may include different cones or a spring package may include different springs, each package preferably intended for individual retail sale. Further, individual rail members, end rails, panel assemblies, and cross support members may be provided in individual packages for individual retail sale. These various individual packages may further enable the functionality of the sleep system 100.

Figure 9:
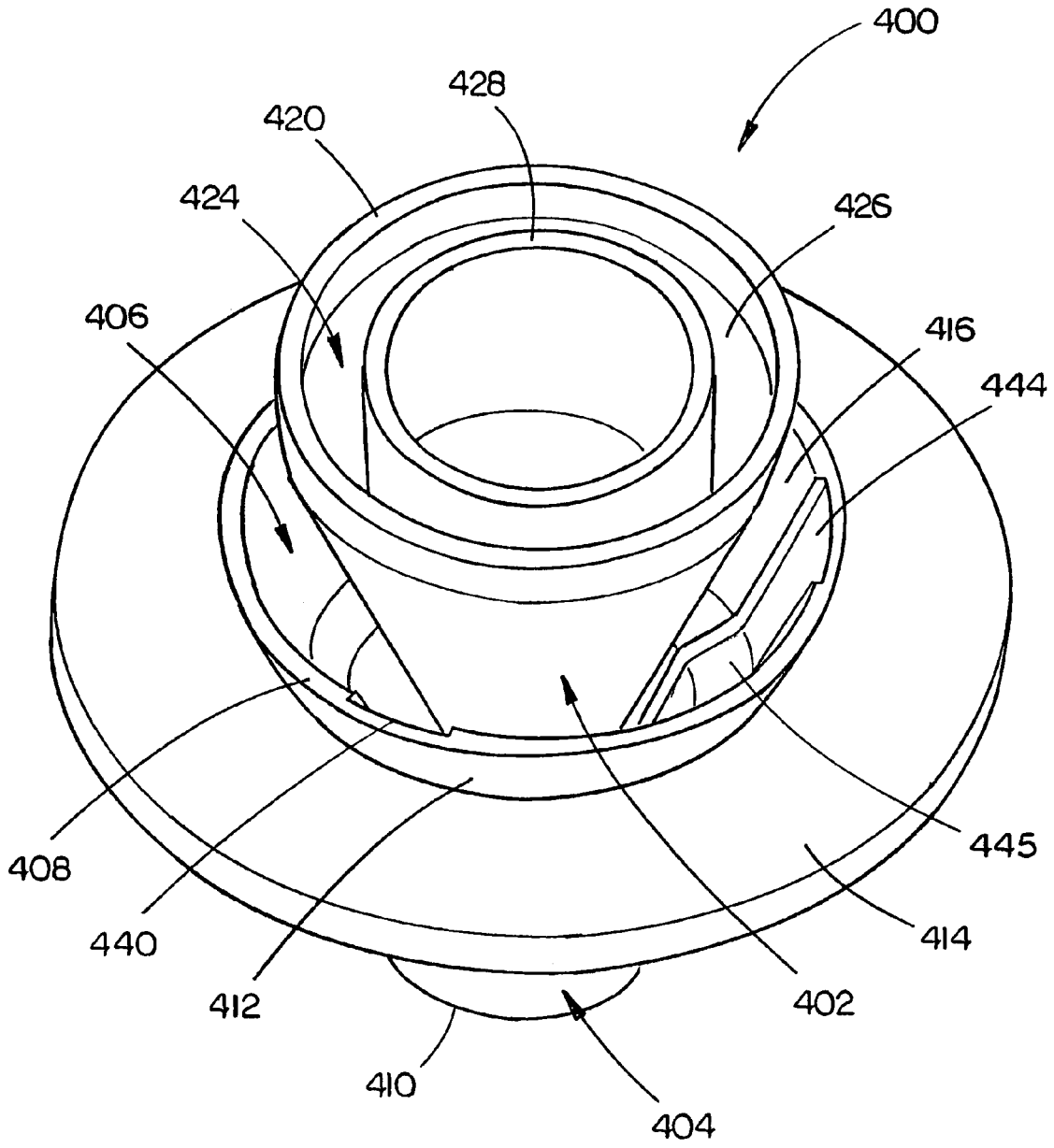
FIG. 9 is an isometric illustration of a second exemplary sleep support mechanism in accordance with an exemplary embodiment of the present invention.
Figure 10:
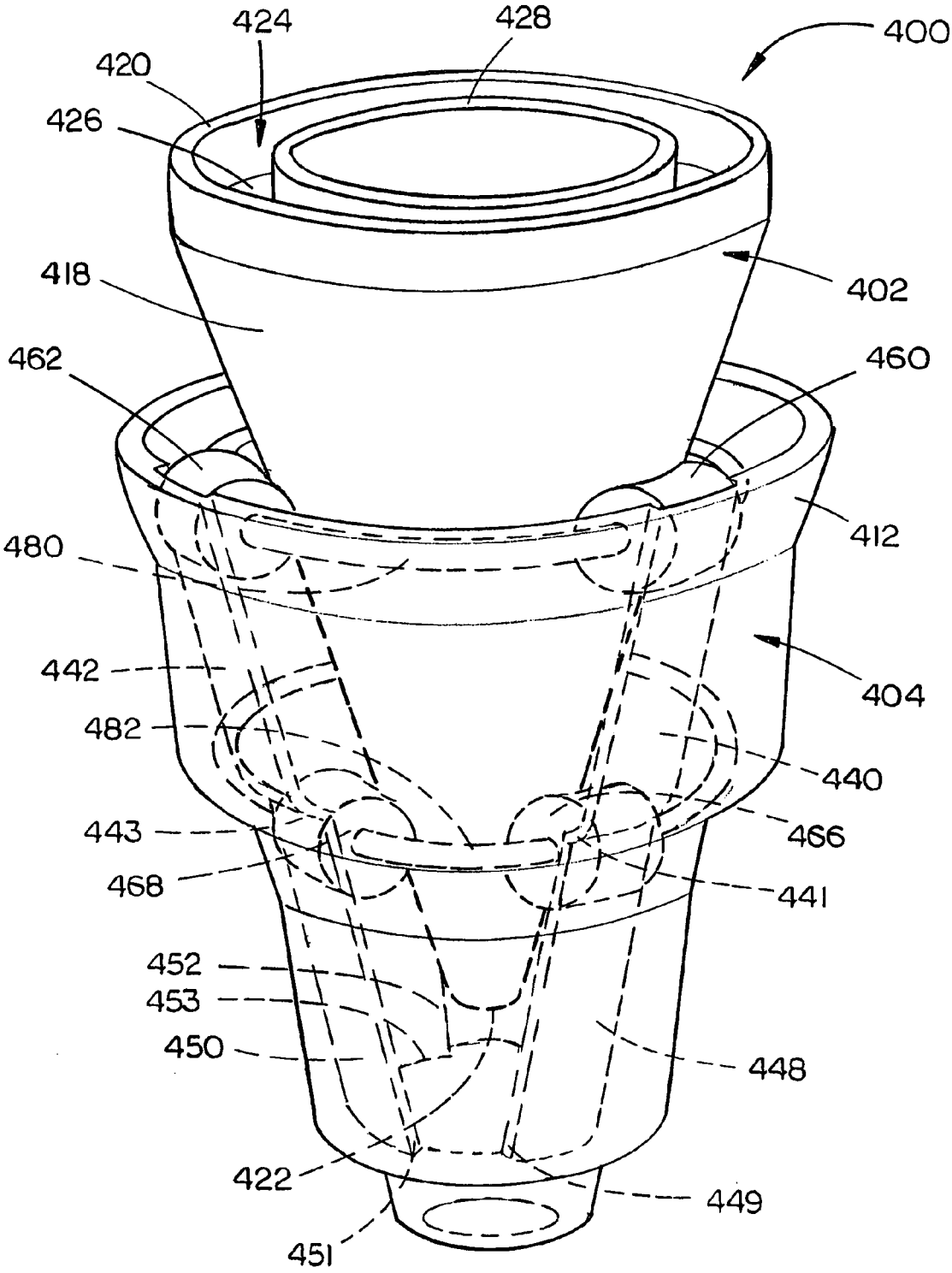
FIG. 10 illustrates a retaining mechanism of the second exemplary sleep support mechanism.

In an alternative embodiment of the present invention, a sleep support mechanism 400 is shown in FIGS. 9 and 10. The sleep support mechanism 400 includes a first cone 402 and a second cone 404. The second cone 404 establishes a defined inner diameter 406 which tapers from a first end 408 to a second end 410. The inner diameter 406 may establish the first end 408 with a four to five inch range which tapers to the second end 410. Alternative embodiments, establishing the inner diameter 406 with the first end 408 and second end 410 having various size ranges are contemplated by the present invention. An outer surface 412 of the second cone 404 may be coupled with an engagement member, which in a preferred embodiment is an outer disk 414. The outer disk 414, in alternative embodiments, may be integrated with the outer surface 412. In a preferred embodiment, the outer disk 414 is disposed proximally to the first end 408. However, the location of the outer disk 414 may be varied to accommodate various needs.

The inner diameter 406 includes an inner wall 416 which further includes a retaining mechanism. In a preferred embodiment, the retaining mechanism, is an O-ring retaining mechanism comprising a plurality of travel guides including a plurality of stops. In the current embodiment, the inner wall 416 includes a first travel guide 440 coupled with a first stop 441, a second travel guide 442 coupled with a second stop 443, a third travel guide 444 coupled with a third stop 445, a fourth travel guide 448 coupled with a fourth stop 449, a fifth travel guide 450 coupled with a fifth stop 451, and a sixth travel guide 452 coupled with a sixth stop 453. In the current embodiment, the first through third travel guides and stops establish a first concentric level and the fourth through sixth travel guides and stops establish a second concentric level. The first and second level engages with differently configured support mechanisms, as will be described below.

The plurality of travel guides may be engaged by a plurality of O-ring elements which may travel the length defined by the travel guide coupled with the stop. In the current embodiment, a first O-ring element 460 engages with the first travel guide 440, a second O-ring element 462 engages with the second travel guide 442, a third O-ring element 464 engages with the third travel guide 444, a fourth O-ring element 466 engages with the fourth travel guide 448, a fifth O-ring element 468 engages with the fifth travel guide 450, and a sixth O-ring element (not shown) engages with the sixth travel guide 452. The O-ring elements may be variously configured and composed of a variety of materials. In a preferred embodiment, the plurality of O-ring elements are connected via a first ring member 480 and a second ring member 482, to establish a retaining ring. In the current embodiment, the first ring member 480 couples the first through third O-ring elements into a first retaining ring and the second ring member 482 couples the fourth through sixth O-ring elements into a second retaining ring. In correspondence with the tapered configurations presented by the first and second cone 402 and 404, of the sleep support mechanism 400, the first and second ring members may be differently con figured to accommodate the different parameters within the individual areas of operation.

It is contemplated that the number and location of O-ring elements may vary to accommodate a varying number and location of the travel guides and stops. Further, the retaining system establishes a travel and stop mechanism for operationally engaging the first and second retaining ring. The configuration of the retaining ring may be established to correspond with the configuration of the travel guides and stops established on the inner wall 416 of the inner diameter 406. Alternatively, the configuration assumed by the retaining ring may be established in various manners as contemplated by those of ordinary skill in the art.

The first cone 402 presents in a tapered configuration from a first end 420 to a second end 422. The first cone 402 further includes an outer wall 418 and defines a recessed area 424 including an inner wall 426. In a preferred embodiment, the inner wall 426 is coupled with an inner ring 428. The inner ring 428 providing a structural support to the first cone 402. In operation, the first cone 402 is inserted within the defined inner diameter 406 of the second cone 404. Once inserted, the outer wall 418 of the first cone 402 is coupled against the O-ring elements of the first and second retaining rings.

It is understood that the retaining rings may establish the O-ring elements in a plurality of positions relative to the travel guides and stops. Further, it is understood that the retaining rings enable the travel of the O-ring elements in the travel guides. In a preferred embodiment, the retaining rings are initially established in an "up" position with the O-ring elements coupled with a top portion of the travel guides. This "up" position may be established as the default position to which the retaining ring, including the O-ring elements, return through the travel capabilities enabled by the coupling of the O-ring elements with the travel guides.

In operation the sleep support mechanism 400 may be utilized with the sleep system 100. The outer disk 414 may engage against one of the plurality of support member receivers of the panels of the panel assemblies. The outer disk 414 may be of sufficient structural integrity to enable the first cone to insert through the aperture of the support member receiver and hold it in a position, whereby the sleep support mechanism 400 may be engaged by the pad 108. The pad 108 engages against the first end 420 of the first cone 402. As pressure is applied through the pad 108 upon the first cone 402, the first cone 402 travels within the inner diameter 406 of the second cone 404. This travel is at least partially enabled by the retaining ring, which contact the O-ring elements against the outer wall 418 of the first cone 402. The first cone 402 and the retaining rings travel down the inner diameter 406 and the travel guides, respectively. This sleep support mechanism increases a counter pressure applied against the first cone 402 as the pressure supplied against the first end 420 of the first cone 402 is increased. The counter pressure is supplied by the retaining mechanism being forced into an increasingly smaller inner diameter 406 of the second cone 404 due to the tapering of the second cone 404.

In an alternative embodiment of the retaining mechanism, the plurality of O-ring elements may be coupled with the ring member via a swivel assembly. The swivel assembly may provide increased ease of travel and provide optimum resistance characteristics to the O-ring elements and retaining ring during operation.

In another exemplary embodiment of the present invention a method of establishing a bed for sleeping upon by a user, is provided. First the user determines what size configuration for the bed is desired. Upon determining the size requirements, the user then selects a packaged sleep system, of the present invention, enabled to be established in the desired size. The user transports the packaged sleep system to the location where the bed is to be established. Upon reaching the desired location, the user may open the packaged sleep system and remove the component parts. The user may then assemble the sleep system establishing a relatively planer surface engaged by a sleep support mechanism for providing an adjustable support mechanism for sleeping upon. The user then determines the characteristics of the sleep support mechanism and couples it with the panel assemblies. A pad is laid on top of the sleep support mechanism and panel assemblies, thereby providing a bed.

It is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A sleep support mechanism, for establishing a bed, comprising:

a cone member having a first end and a second end, the first end coupling with a pad;

a first spring having a first end and a second end, the first end of the first spring coupling with the first end of the cone member, the second end of the first spring being coupled with a first panel assembly, the first spring for operationally engaging the cone member with the first panel assembly; and a second spring having a first end and a second end, the first end of the second spring coupling with the second end of the cone member, the second end of the second spring coupling with a second panel assembly, the second spring for operationally engaging the cone member with the second panel assembly, wherein the cone member, including the first and second spring, operationally engage the first panel assembly with the second panel assembly to provide adjustable support to the pad.

2. The sleep support mechanism of claim 1, further comprising a frame including a cross support member.

3. The sleep support mechanism of claim 1, further comprising a frame support mechanism.

4. The sleep support mechanism of claim 1, wherein the pad is a mattress.

5. The sleep support mechanism of claim 1, wherein the first and second panel assemblies further comprise a plurality of panels.

6. The sleep support mechanism of claim 1, further comprising bedding materials.

7. The sleep support mechanism of claim 1, wherein the bed is established with a plurality of sleep support mechanisms.

* * * * *